US008544839B2

(12) United States Patent
Ichikawa

(10) Patent No.: US 8,544,839 B2
(45) Date of Patent: Oct. 1, 2013

(54) SHEET FEEDER WITH SLANTED GUIDE SURFACE AND IMAGE FORMING APPARATUS HAVING THE SAME

(75) Inventor: Hiroshi Ichikawa, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/568,181

(22) Filed: Aug. 7, 2012

(65) Prior Publication Data

US 2013/0049289 A1 Feb. 28, 2013

(30) Foreign Application Priority Data

Aug. 31, 2011 (JP) ..... 2011-189009

(51) Int. Cl.
*B65H 3/52* (2006.01)

(52) U.S. Cl.
CPC ..... *B65H 3/5223* (2013.01)
USPC ..... 271/121

(58) Field of Classification Search
USPC ..... 271/121, 167
See application file for complete search history.

(56) References Cited

U.S. PATENT DOCUMENTS 5,951,003 A * 9/1999 Nojima et al. ..... 271/121
7,021,621 B2 4/2006 Asada et al.
7,913,997 B2 3/2011 Watanabe
2002/0003332 A1 1/2002 Hiratani
2004/0012140 A1 1/2004 Asada et al.
2008/0191407 A1 8/2008 Watanabe
2008/0211169 A1 * 9/2008 Klein ..... 271/167

FOREIGN PATENT DOCUMENTS

EP 409153 A2 * 1/1991
JP 61-008651 1/1986
JP 2002-326723 11/2002
JP 2004-051302 2/2004
JP 2008-195498 8/2008
JP 2009-208857 9/2009
JP 2010-241535 10/2010

* cited by examiner

*Primary Examiner* — Gerald McClain
(74) *Attorney, Agent, or Firm* — Banner & Witcoff, Ltd.

(57) ABSTRACT

A sheet feeder is provided that includes a friction member that includes a contact pressure surface that is configured to contact a feed roller when there is no sheet between the friction member and the feed roller and disposed closer to the feed roller than an upper surface of a supporting member supporting the friction member such that a virtual tangential plane, which is such a virtual plane as if the contact pressure surface were extended toward an upstream side and a downstream side in a sheet feeding direction, does not intersect with the supporting member, and a slanted guide surface that is disposed upstream relative to the contact pressure surface in the sheet feeding direction and slanted with respect to the virtual tangential plane so as to be farther away down from the virtual tangential plane toward the upstream side in the sheet feeding direction.

11 Claims, 5 Drawing Sheets

SHEET FEEDER WITH SLANTED GUIDE SURFACE AND IMAGE FORMING APPARATUS HAVING THE SAME

CROSS-REFERENCE TO RELATED APPLICATION

This application claims priority under 35 U.S.C. §119 from Japanese Patent Application No. 2011-189009 filed on Aug. 31, 2011. The entire subject matter of the application is incorporated herein by reference.

BACKGROUND

1. Technical Field

The following description relates to one or more sheet feeders and image forming apparatuses provided therewith.

2. Related Art

A sheet feeder has been known that includes a friction member configured to contact a bottom one of stacked sheets in a sheet staking direction, so as to prevent such a failure that two or more sheets are fed together in a mutually overlapping state (hereinafter, the failure may be referred to as "multi feed").

In the known sheet feeder, a feed roller is configured to apply a feeding force to the stacked sheets by rotating in contact with an upward-facing side of a top one of the stacked sheets in the sheet stacking direction. Hence, in the known sheet feeder, in order to prevent the multi feed, the friction member is provided to contact a downward-facing side of the bottom one of the stacked sheets in the sheet stacking direction, and thereby a frictional force is applied to the stacked sheets against the feeding force.

In the known sheet feeder, at a portion (hereinafter referred to as a supporting member) on which the friction member is disposed, a recessed section is formed such that the friction member is fitted thereinto. Further, the recessed section is formed with a depth as long as the thickness of the friction member, such that an upper surface of the friction member and an upper surface of the supporting member are at the same level. Thereby, it is possible to certainly establish contact between the friction member and the bottom sheet.

If the friction member is, in a simple form, disposed on the upper surface of the supporting member without any recessed section being formed, the upper surface of the friction member has to be higher than the upper surface of the supporting member. Namely, when the friction member is disposed on the upper surface of the supporting member, the upper surface of the friction member and the upper surface of the supporting member have to form a step-shaped boundary therebetween such that the downstream one of the two upper surfaces is higher than the upstream one thereof in a sheet feeding direction.

The friction member generally has a thickness more than that of a sheet to be fed (such as a recording sheet and a document sheet). Therefore, the aforementioned step-shaped boundary might cause an undesired situation such as empty feed and a wrinkled or folded sheet, as described below.

SUMMARY

However, the thickness of the friction member and the depth of the recessed section have dimensional variations within predetermined tolerances. Therefore, even when the recessed section is formed, the upper surface of the friction member might protrude or be recessed from the upper surface of the supporting member.

When the upper surface of the friction member protrudes from the upper surface of the supporting member, a leading end of the sheet in the sheet feeding direction might collide against an upstream end of the friction member in the sheet feeding direction. Thus, it might result in a feed failure such as empty feed in which the sheet is no longer fed downstream in the sheet feeding direction and the sheet wrinkled or folded at the time of the collision.

Meanwhile, when the upper surface of the friction member is recessed from the upper surface of the supporting member, it leads to a low contact pressure between the sheet and the friction member. In such a case, a sufficient frictional force is not applied to the sheets, and thus multi feed is caused.

The aforementioned problems might be caused in not only a sheet feeder of an image forming apparatus but also an automatic document feeder of an image reading apparatus.

Aspects of the present invention are advantageous to provide one or more improved techniques, for a sheet feeder and an image forming apparatus having the same, which techniques make it possible to prevent the aforementioned undesired situations such as multi feed, empty feed, and a wrinkled or folded sheet.

According to aspects of the present invention, a sheet feeder configured to feed sheets is provided, the sheet feeder including a friction member configured to contact a bottom one of the sheets to be fed and apply a frictional resistance to the sheets, a feed roller disposed to face the friction member, the feed roller configured to provide a feeding force to the sheets by rotating while contacting a top one of the sheets and applying to the sheets a pressing force for pressing the sheets against the friction member, a supporting member attached to a main body of the sheet feeder, the supporting member being configured to support the friction member and receive the pressing force from the feed roller via the friction member, and a separation roller configured to separate a plurality of sheets fed by the feed roller on a sheet-by-sheet basis, the friction member including a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane being such a virtual plane as if the contact pressure surface were extended toward an upstream side and a downstream side in a sheet feeding direction, and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction.

According to aspects of the present invention, further provided is an image forming apparatus that includes an image forming unit configured to form an image on a sheet, and a sheet feeder configured to feed sheets, the sheet feeder including a friction member configured to contact a bottom one of the sheets to be fed and apply a frictional resistance to the sheets, a feed roller disposed to face the friction member, the feed roller configured to provide a feeding force to the sheets by rotating while contacting a top one of the sheets and applying to the sheets a pressing force for pressing the sheets against the friction member, a supporting member attached to a main body of the sheet feeder, the supporting member being configured to support the friction member and receive the pressing force from the feed roller via the friction member, and a separation roller configured to separate a plurality of sheets fed by the feed roller on a sheet-by-sheet basis, the friction member including a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane being such a virtual plane as if the contact pressure surface were extended toward an upstream side and a downstream side in a sheet feeding direction, and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction.

According to aspects of the present invention, further provided is a sheet feeder configured to feed sheets, which includes a friction member configured to contact a bottom one of the sheets to be fed and apply a frictional resistance to the sheets, the friction member being formed to have an even thickness over an entire length thereof in a sheet feeding direction, a feed roller disposed to face the friction member, the feed roller configured to provide a feeding force to the sheets by rotating while contacting a top one of the sheets and applying to the sheets a pressing force for pressing the sheets against the friction member, a supporting member attached to a main body of the sheet feeder, the supporting member being configured to support the friction member and receive the pressing force from the feed roller via the friction member, the supporting member being formed to have a bent surface on which the friction member is attached, and a separation roller configured to separate a plurality of sheets fed by the feed roller on a sheet-by-sheet basis, the friction member including a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane being such a virtual plane as if the contact pressure surface were extended toward an upstream side and a downstream side in the sheet feeding direction, and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments according to aspects of the present invention will be described with reference to the accompanying drawings.

(First Embodiment)

1. Overview Configuration of Image Forming Apparatus

Figure 1:
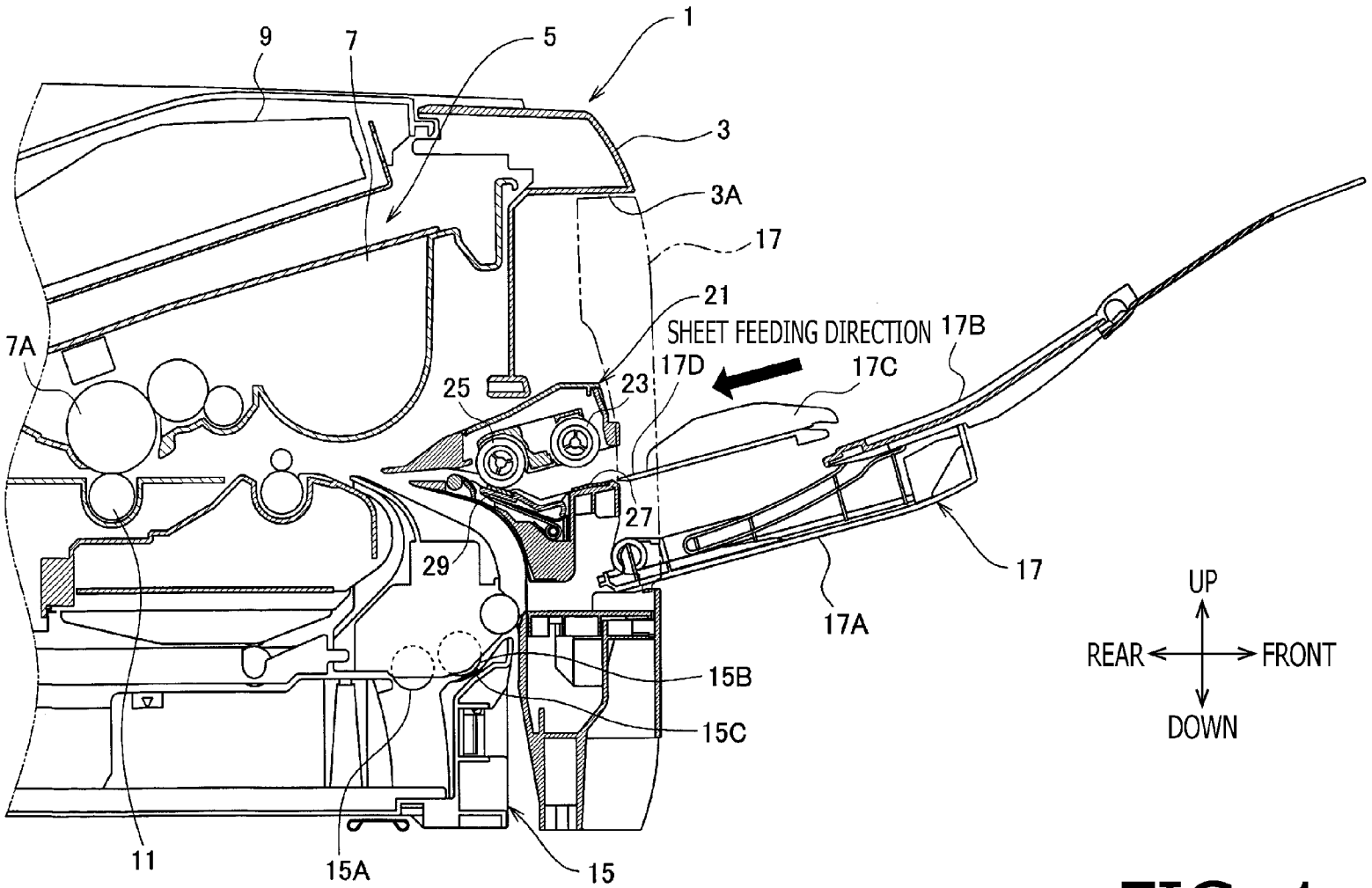
FIG. 1 is a cross-sectional side view showing a front side of an image forming apparatus in a first embodiment according to one or more aspects of the present invention.

As shown in FIG. 1, a housing 3 of an image forming apparatus 1 accommodates an image forming unit 5 configured to perform monochrome printing to form an image on a sheet (such as a recording sheet and a transparency) by transferring a developer image onto the sheet.

In the first embodiment, the image forming unit 5 is an electrophotographic image forming unit that includes a process cartridge 7 forming a development unit, an exposure unit 9 configured to expose a photoconductive drum 7A, a transfer roller 11 configured to transfer onto the sheet the developer image formed on the photoconductive drum 7A, and a fixing unit (not shown) configured to fix the developer image transferred onto the sheet.

A feed cassette 15 is configured to accommodate sheets stacked therein that are to be fed to the image forming unit 5. The feed cassette 15 is detachably attached to a main body (the housing 3) of the image forming apparatus 1.

After being picked up and fed by a pickup roller 15A toward the image forming unit 5, the sheets placed in the feed cassette 15 are separated on a sheet-by-sheet basis by a separation roller 15B and a separation pad 15C and fed to the image forming unit 5.

The housing 3 includes a sheet supply port 3A provided at a front face thereof. The sheet supply port 3A is configured to accept sheets (other than the sheets placed in the feed cassette 15) to be directly supplied to the image forming unit 5. In a usual use state, as indicated by a long dashed double-short dashed line, the sheet supply port 3A is closed with a multi-purpose feed tray 17 that is swingably attached to the housing 3. It is noted that the usual use state includes a state where a sheet is supplied from the feed cassette 15.

Figure 2:
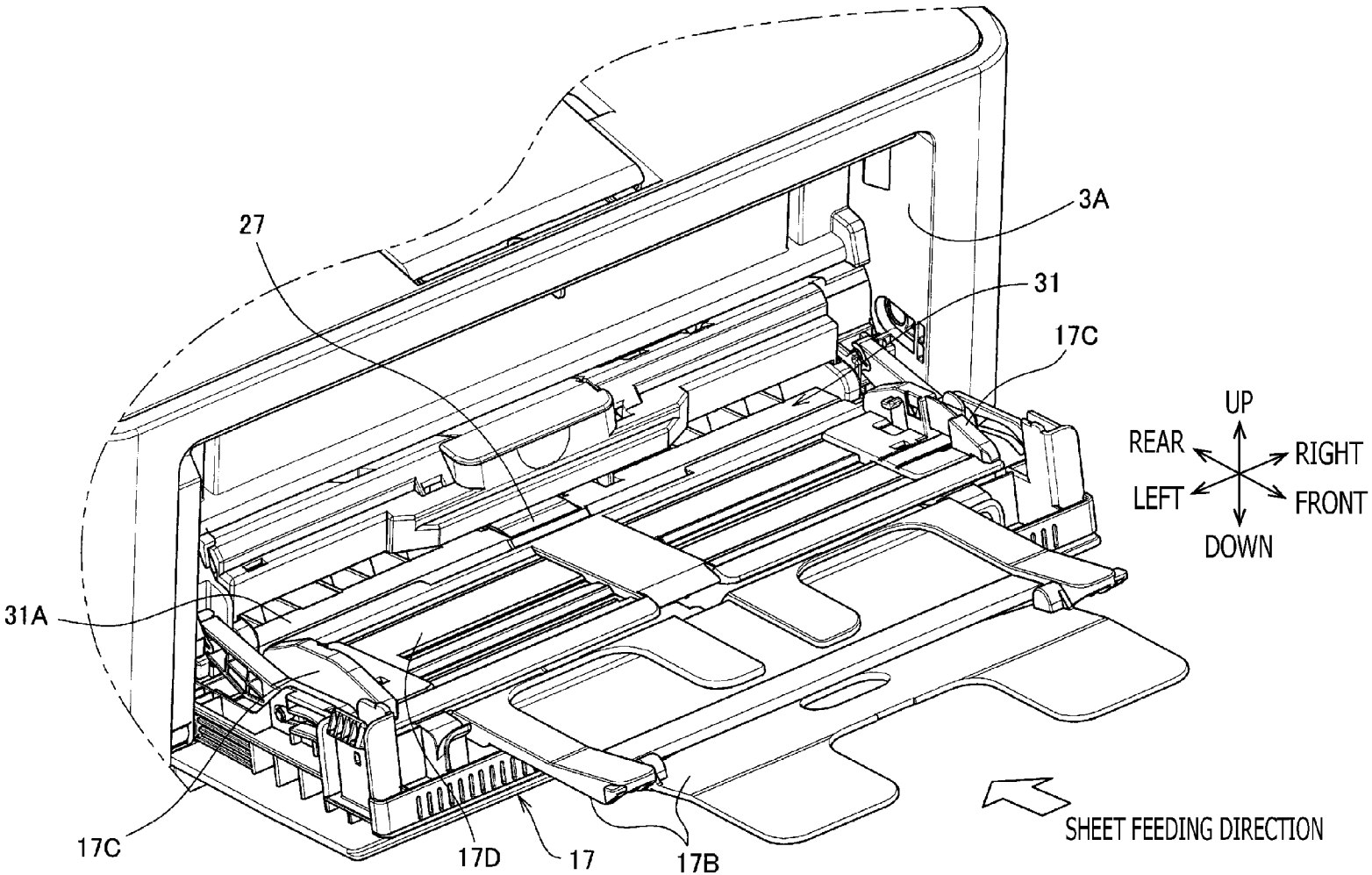
FIG. 2 is a perspective view showing the front side of the image forming apparatus in the first embodiment according to one or more aspects of the present invention.

When a multi-purpose feed tray 17 (hereinafter, simply referred to as an "MP tray 17") is opened forward by a user, as shown in FIG. 2, the sheet supply port 3A is rendered open so as to accept sheets supplied therefrom. Further, the MP tray 17 serves as a guide member configured to guide the sheets supplied from the sheet supply port 3A.

As shown in FIG. 1, to a tray main body 17A of the MP tray 17, an extension tray 17B is movably attached, which is configured to extend a portion for bearing sheets placed thereon. Additionally, to the tray main body 17A, two guide sections 17C are movably attached thereto, which are configured to guide a sheet fed therealong in contact with ends in a width direction of the sheet.

It is noted that the width direction of the sheet is a direction perpendicular to a feeding direction and a thickness direction of the sheet. Specifically, the width direction corresponds to the left-to-right direction of the image forming apparatus 1 (see FIG. 2).

Figure 3:
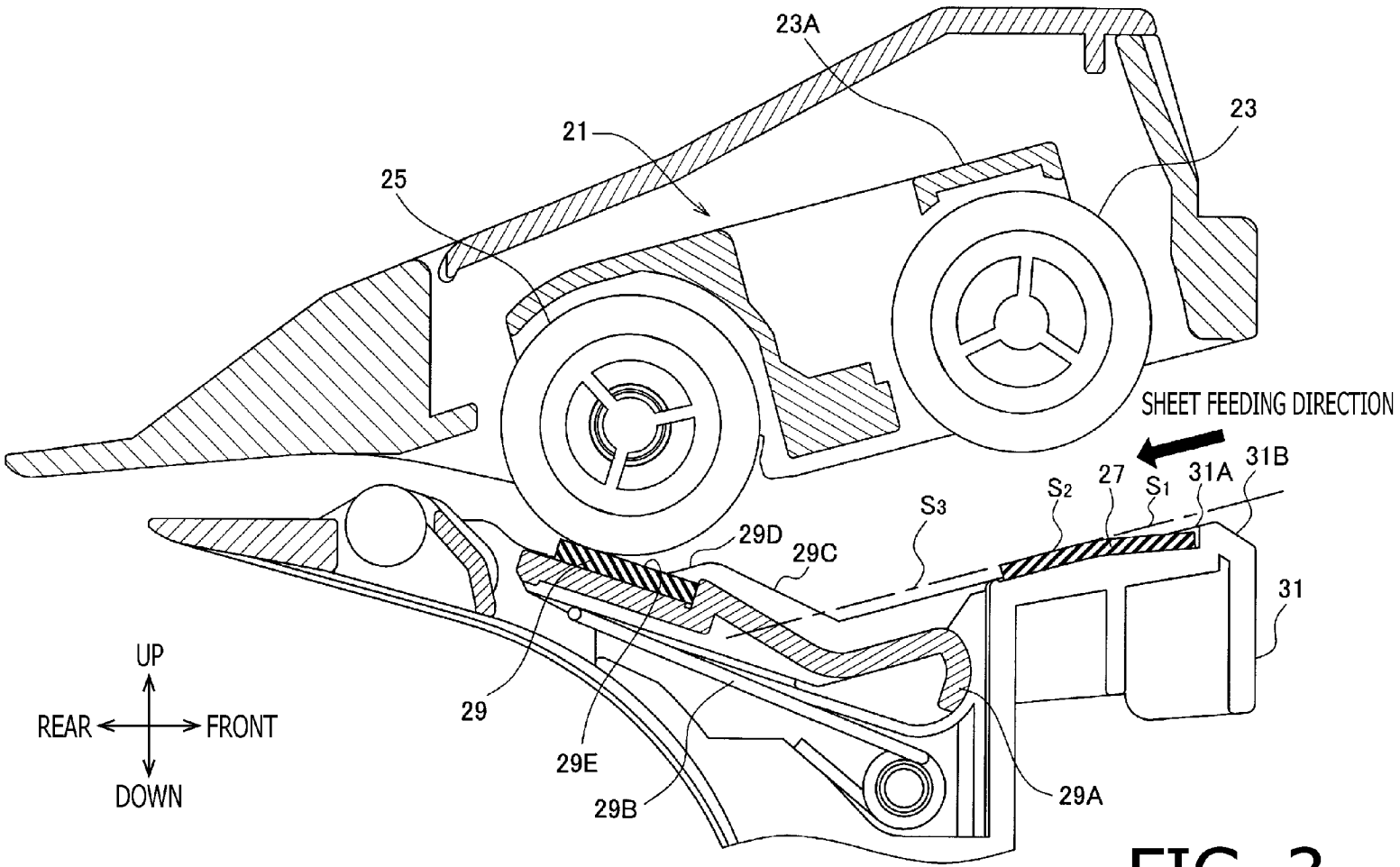
FIG. 3 is an enlarged view of a feeding unit of the image forming apparatus in the first embodiment according to one or more aspects of the present invention.

2. Configuration for Supplying Sheet to Image Forming Unit from Sheet Supply Port As shown in FIG. 3, in the housing 3, there is provided a feeding unit 21 that is configured to feed sheets placed on the MP tray 17. The feeding unit 21 includes a feed roller 23, a separation roller 25, a friction member 27, a separation pad 29, and a driving mechanism (not shown) configured to drive the feed roller 23 and the separation roller 25 to rotate.

The friction member 27 is a cork pad configured to contact a downward-facing side of a bottom one of the sheets placed on the MP tray 17 so as to apply a frictional resistance to the sheets. Further, the friction member 27 is formed to have an even thickness over an entire length thereof in the sheet feeding direction. In a position opposed to the friction member 27, the feed roller 23 is disposed. The feed roller 23 is configured to apply a feeding force to the sheets by rotating while contacting an upward-facing side of a top one of the sheets placed on the MP tray 17 and pressing the sheets against the friction member 27.

Figure 4:
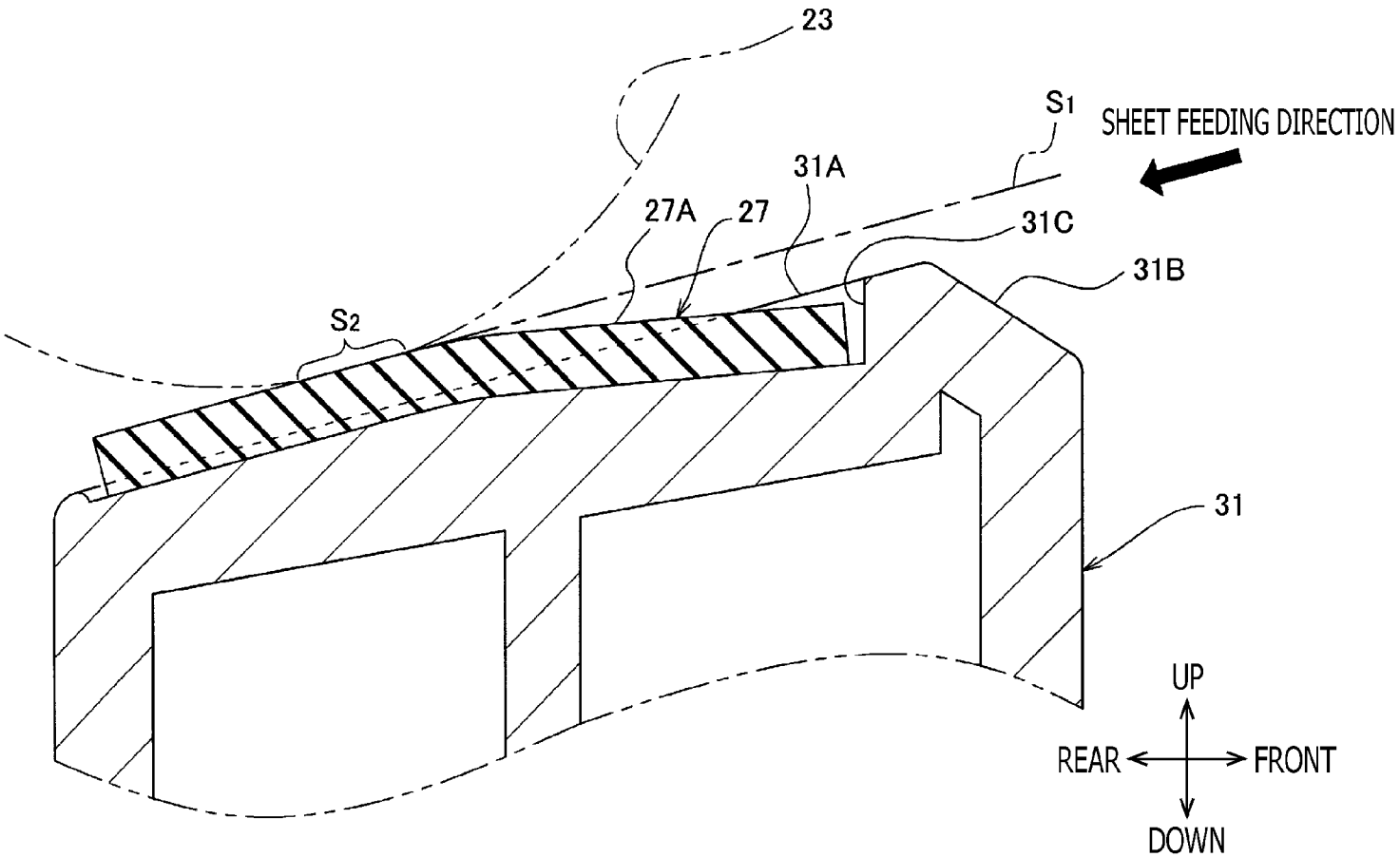
FIG. 4 is an enlarged cross-sectional side view showing a friction member and a part therearound of the image forming apparatus in the first embodiment according to one or more aspects of the present invention.

In the first embodiment, the feed roller 23 is configured to swing around a rotational axis of the separation roller 25 between a separation position separated from the friction member 27 (see FIG. 3) and a proximity position located in proximity to the friction member 27 (see a long dashed double-short dashed line in FIG. 4).

When applying the feeding force to the sheets, the feed roller 23 is in the proximity position to press the sheets against the friction member 2. Meanwhile, when not applying the feeding force to the sheets, the feed roller 23 is swung up to the separation position by a swing mechanism (not shown).

In the first embodiment, as an example of the pressing force that the feed roller 23 applies to press the sheets against the friction member 27, employed is an elastic force of a spring (not shown) that acts on the feed roller 23 and a holder 23A supporting the feed roller 23. The elastic force is transmitted to the holder 23A via a link mechanism.

The separation roller 25 is disposed at a side downstream relative to the feed roller 23 in the sheet feeding direction. The separation roller 25 is configured to separate a plurality of sheets fed by the feed roller 23 and feed the plurality of sheets toward the image forming unit 5 in a manner separated on a sheet-by-sheet basis. The separation pad 29 is a rubber pad that is disposed to face the separation roller 25 and configured to apply a feeding resistance to the plurality of sheets.

The separation roller 25 is configured to rotate without being displaced relative to the main body of the image forming apparatus 1. The separation pad 29 is swingably attached to the main body of the image forming apparatus 1 via a pad holder 29A. The separation pad 29 is pressed against the separation roller 25 by a spring 29B (such as a coil spring) via the pad holder 29A.

It is noted that the main body of the image forming apparatus 1 is a frame member (not shown) for supporting the housing 3 and the image forming unit 5. In addition, the friction member 27 is supported by a supporting member 31 fixedly attached to the main body of the image forming apparatus 1. As shown in FIG. 2, the supporting member 31 is a beam member that extends in the width direction and fixedly attached to the main body of the image forming apparatus 1. Therefore, the pressing force that the feed roller 23 applies to the friction member 27 is transmitted via the friction member 27 and received by the supporting member 31.

As shown in FIG. 2, an upper surface 31A of the supporting member 31 is configured to be parallel to and continuous with a loading surface 17D. As shown in FIG. 4, an upstream end of the upper surface 31A in the sheet feeding direction includes a slanted surface 31B. It is noted that the loading surface 17D is configured such that a sheet to be supplied from the sheet supply port 3A to the image forming unit 5 is placed thereon. The loading surface 17D has the guide sections 17C provided thereon.

The slanted surface 31B is slanted with respect to a first virtual tangential plane S1 so as to be farther away down from the first virtual tangential plane S1 toward the upstream side. In the first embodiment, the first virtual tangential plane S1 and the slanted surface 31B form an angle of about 45 degrees.

It is noted that the first virtual tangential plane S1 is such a virtual plane as if a portion (hereinafter referred to as a "contact pressure surface S2") of the friction member 27 that contacts the feed roller 23 in a situation where there is no sheet between the friction member 27 and the feed roller 23 were extended toward an upstream side in the sheet feeding direction.

The friction member 27 is provided on the supporting member 31 such that the contact pressure surface S2, which is a frictional surface, is parallel to the upper surface 31A of the supporting member 31 and closer to the feed roller 23 than the upper surface 31A. Therefore, in the first embodiment, the first virtual tangential plane S1, which is such a virtual plane as if the contact pressure surface S2 were extended toward the upstream side in the sheet feeding direction, does not intersect with the supporting member 31.

At an upstream portion of the friction member 27 relative to the contact pressure surface S2 in the sheet feeding direction, a slanted guide surface 27A is provided. The slanted guide surface 27A is slanted with respect to the first virtual tangential plane S1 so as to be farther away down from the first virtual tangential plane S1 toward the upstream side in the sheet feeding direction.

In the first embodiment, the friction member 27, which includes the slanted guide surface 27A, is formed from a rectangular cork plate, with a region of the plate-shaped friction member 27 that connects the slanted guide surface 27A with the contact pressure surface S2 being curved in the shape of a smoothly continuous arc. It is noted that, in the first embodiment, the first virtual tangential plane S1 and the slanted guide surface 27A form an angle of about 10 degrees.

Further, at a region of the supporting member 31 where the friction member 27 is disposed, there is provided a recessed section 31C that is recessed downward from the upper surface 31A. A lower surface of the friction member 27 is fixedly attached to a bottom surface (a bent surface) of the recessed section 31C in a bonding method using a double-faced adhesive tape or adhesive material.

The bottom surface of the recessed section 31 is formed to be parallel to the upper surface of the friction member 27 including the slanted guide surface 27A. A recess depth at an upstream side of the bottom surface of the recessed section 31C in the sheet feeding direction is set such that the upstream end of the slanted guide surface 27A in the sheet feeding direction is lower than the upper surface 31A. Therefore, corners of the upstream end of the slanted guide surface 27A in the sheet feeding direction have to be in the recessed section 31C.

As shown in FIG. 3, between the separation roller 25 and the feed roller 23, slanted guide sections 29C are provided. The slanted guide sections 29C are continuous with an opposed surface 29E opposed to the separation roller 25, in a state slanted with respect to a second virtual tangential plane S3 so as to be farther away up from the second virtual tangential plane S3 toward a downstream side in the sheet feeding direction.

It is noted that the second virtual tangential plane S3 is such a virtual plane as if the contact pressure surface S2 were extended toward the downstream side in the sheet feeding direction. In the first embodiment, the second virtual tangential plane S3 and the slanted guide sections 29C form an angle of about 40 degrees.

In the first embodiment, the slanted guide sections 29C are configured to guide, toward the separation roller 25, the sheet fed by the feed roller 23. The slanted guide sections 29C are rib-shaped distal ends of projections (i.e., protruding ridges) of the supporting member 31 that are formed on both sides of the pad holder 29A in the left-to-right direction. Further, the opposed surface 29E corresponds to a frictional surface of the separation pad 29.

The slanted guide sections 29C and the opposed surface 29E have only to be continuous with each other so as to be able to guide, toward the separation roller 25, the sheet fed by the feed roller 23. Therefore, in the first embodiment, the slanted guide sections 29C and the opposed surface 29E are continuous with each other, with a step formed therewith that has slopes 29D.

3. Features of Image Forming Apparatus in First Embodiment

In the first embodiment, as shown in FIG. 4, the contact pressure surface S2 is disposed closer to the feed roller 23 than the upper surface 31A. Thereby, it is possible to certainly establish contact between the friction member 27 and a bottom one of sheets. Thus, it is possible to certainly apply a frictional force to the sheets and thereby certainly avoid multi feed that might be caused when a low frictional force is applied to the sheets.

Further, the slanted guide surface 27A of the friction member 27 is provided at the upstream side relative to the contact pressure surface S2 in the sheet feeding direction. Therefore, the slanted guide surface 27A functions as a guide surface for guiding the sheets to the contact pressure surface S2. Namely, when sheets are inserted between the friction member 27 and the feed roller 23, the slanted guide surface 27A serves as a guide surface for guiding the sheets to the contact pressure surface S2. Hence, it is possible to easily insert the sheets and prevent a feed failure that might be caused when leading ends of the sheets in the sheet feeding direction collide against an upstream end of the friction member 27 in the sheet feeding direction.

As described above, in the first embodiment, it is possible to make it easier to insert the sheets and prevent undesired situations such as feed failures and multi feed. Further, in the first embodiment, at the upstream end of the supporting member 31 in the sheet feeding direction, the slanted surface 31B is provided that is slanted with respect to the first virtual tangential plane S1 so as to be farther away down from the first virtual tangential plane S1 toward the upstream side.

Accordingly, since the slanted surface 31B functions as a guide surface for guiding the sheets to the slanted guide surface 27A, it is possible to smoothly insert the sheets from the side of the MP tray 17. Further, in the first embodiment, the slanted guide surface 27A is formed with an upstream region of the friction member 27 relative to the contact pressure surface S2 in the sheet feeding direction being curved.

Thereby, for instance, compared with a case where the slanted guide surface 27A is formed with an upstream region of the friction member 27 in the sheet feeding direction being cut, it is possible to more easily form the slanted guide surface 27A.

When a sheet is pressed against the friction member 27 by the feed roller 23, the sheet is put into such a state that the sheet is along the contact pressure surface S2 and positionally coincident with the first virtual tangential plane S1. Therefore, if the first virtual tangential plane S1 were a plane not parallel to but intersecting with the upper surface 31A of the supporting member 31, the sheet might come into contact with the supporting member 31.

Then, when the sheet contacts the supporting member 31, a pressing force of the feed roller 23 is received by a portion other than the contact pressure surface S2, i.e., a portion of the supporting member 31 that contacts the sheet as well. Therefore, the pressing force is dispersed, and it results in a lowered frictional force generated between the contact pressure surface S2 and the sheet. Thus, multi feed is more likely to be caused.

On the contrary, in the first embodiment, the contact pressure surface S2 is parallel to the upper surface 31A of the supporting member 31, and the first virtual tangential plane S1 does not intersect with the upper surface 31A of the supporting member 31. Accordingly, in the first embodiment, the pressing force of the feed roller 23 acts on the contact pressure surface S2 without being dispersed. Thus, it is possible to prevent the frictional force generated between the contact pressure surface S2 and the sheet from being lowered and to certainly avoid multi feed.

Further, in the first embodiment, between the separation roller 25 and the feed roller 23, the slanted guide sections 29C are provided that are slanted with respect to the second virtual tangential plane S3 so as to be farther away up from the second virtual tangential plane S3 toward the downstream side in the sheet feeding direction. Further, the slanted guide sections 29C are continuous with the opposed surface 29E opposed to the separation roller 25.

Thereby, in the first embodiment, it is possible to cause slight displacement of the leading ends in the sheet feeding direction of a plurality of sheets fed by the feed roller 23, forward in the sheet feeding direction in a wedge shape along the slanted guide sections 29C.

Accordingly, it is possible to prevent the plurality of sheets from being fed all together in a bundle toward the separation roller 25. Thus, it is possible to separate the plurality of sheets fed by the feed roller 23 on a sheet-by-sheet basis.

In the first embodiment, a step is formed between the slanted guide sections 29C and the opposed surface 29E. Nevertheless, the step is formed by the situation where the opposed surface 29E, located downstream relative to the slanted guide sections 29C in the sheet feeding direction, is below an extended virtual plane of the slanted guide sections 29C. Thus, the step does not disturb feeding of sheets.

It is noted that the extended virtual plane of the slanted guide sections 29C is such a virtual plane as if the slanted guide sections 29C were extended along the slanted guide sections 29C toward a downstream side in the sheet feeding direction.

(Second Embodiment)

Figure 5:
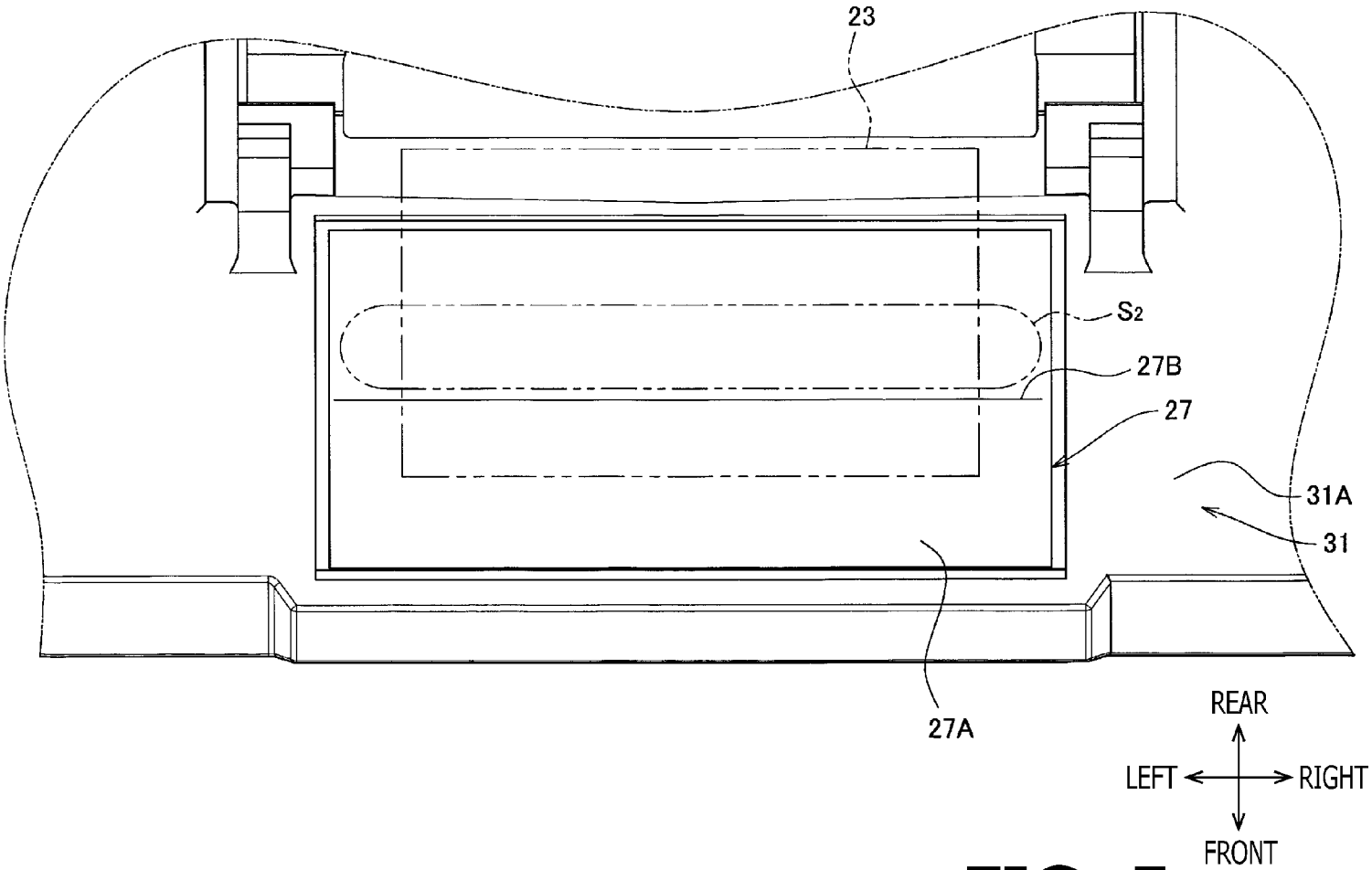
FIG. 5 is a top view showing a friction member and a part therearound of the image forming apparatus in a second embodiment according to one or more aspects of the present invention.

In a second embodiment, as shown in FIG. 5, at a region of the friction member 27 that extends from the contact pressure surface S2 to the slanted guide surface 27A, a slit 27B is provided that is cut in down in a thickness direction of the friction member 27.

Thereby, in the second embodiment, for instance, when the slanted guide surface 27A is formed by bending the plate-shaped friction member 27, it is possible to specify a portion of the friction member 27 to be bent. Thus, it is possible to easily form the slanted guide surface 27A.

Further, since the friction member 27 includes the slit 27B, it is possible to reduce a restoring force that tends to bring the bent friction member 27 back into an original shape. Therefore, when the friction member 27 is fixedly attached to the main body of the image forming apparatus 1 with a double-faced adhesive tape or adhesive material, it is hard for the bent friction member 27 to be detached from the min body. Thus, it is possible to stably feed sheets over a long period of time.

Hereinabove, the embodiments according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present invention. It is to be understood that the present invention is capable of use in various other combinations and environments and is capable of changes or modifications within the scope of the inventive concept as expressed herein. For example, the following modifications are possible.

(Modifications)

In the aforementioned embodiments, aspects of the present invention are applied to the feeding unit 21 of the image forming apparatus 1. However, aspects of the present invention may be applied to a sheet feeder such as an automatic document feeder (ADF) of an image reading device.

In the aforementioned embodiments, aspects of the present invention are applied to the feeding unit 21 configured to feed sheets placed on the MP tray 17. However, aspects of the present invention may be applied to a sheet feeder for feeding sheets placed in the feed cassette 15.

In the aforementioned embodiments, the feed roller 23 is configured to change the position thereof between when feeding sheets and when not feeding any sheets. However, the feed roller 23 may be fixed to such a position as to be able to contact a sheet placed on the MP tray 17.

In the aforementioned embodiments, the recessed section 31C is formed at the region of the supporting member 31 where the friction member 27 is disposed. However, for instance, the recessed section 31C may not be provided, and in this case, the friction member 27 may be disposed such that the slanted guide surface 27A is located upstream relative to the supporting member 31 in the sheet feeding direction.

In the aforementioned embodiments, the slanted guide sections 29C are continuous with the opposed surface 29E via the slopes 29D. However, for instance, the slanted guide sections 29C and the opposed surface 29E may smoothly be continuous with each other without any step. Alternatively, the slanted guide sections 29C and the opposed surface 29E may be continuous with each other without the slopes 29D.

What is claimed is:

1. A sheet feeder configured to feed sheets, comprising:

a friction member configured to contact a bottom one of the sheets to be fed and apply a frictional resistance to the sheets;

a feed roller disposed to face the friction member, the feed roller configured to provide a feeding force to the sheets by rotating while contacting a top one of the sheets and applying to the sheets a pressing force for pressing the sheets against the friction member;

a supporting member attached to a main body of the sheet feeder, the supporting member being configured to support the friction member and receive the pressing force from the feed roller via the friction member; and a separation roller configured to separate a plurality of sheets fed by the feed roller on a sheet-by-sheet basis, the friction member comprising:

a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane of the contact pressure surface extending toward an upstream side and a downstream side in a sheet feeding direction; and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction;

wherein the contact pressure surface is parallel to the upper surface of the supporting member.

2. The sheet feeder according to claim 1, wherein the supporting member comprises a slanted surface disposed at an upstream end of the supporting member in the sheet feeding direction, the slanted surface being slanted with respect to the virtual tangential plane so as to be farther away down from the virtual tangential plane toward the upstream side in the sheet feeding direction.

3. The sheet feeder according to claim 1, wherein the slanted guide surface is formed with an upstream region of the friction member relative to the contact pressure surface in the sheet feeding direction being curved.

4. The sheet feeder according to claim 1, further comprising:

a slanted section disposed between the separation roller and the feed roller, the slanted section being continuous with an opposed surface that is opposed to the separation roller, the slanted section being slanted with respect to the virtual tangential plane so as to be farther away up from the virtual tangential plane toward the downstream side in the sheet feeding direction.

5. The sheet feeder according to claim 1, wherein the friction member comprises a slit disposed at a region that extends from the contact pressure surface to the slanted guide surface, the slit being cut in a thickness direction of the friction member.

6. An image forming apparatus comprising:

an image forming unit configured to form an image on a sheet; and a sheet feeder configured to feed sheets, the sheet feeder comprising:

a friction member configured to contact a bottom one of the sheets to be fed and apply a frictional resistance to the sheets;

a feed roller disposed to face the friction member, the feed roller configured to provide a feeding force to the sheets by rotating while contacting a top one of the sheets and applying to the sheets a pressing force for pressing the sheets against the friction member;

a supporting member attached to a main body of the sheet feeder, the supporting member being configured to support the friction member and receive the pressing force from the feed roller via the friction member; and a separation roller configured to separate a plurality of sheets fed by the feed roller on a sheet-by-sheet basis, the friction member comprising:

a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane of the contact pressure surface extending toward an upstream side and a downstream side in a sheet feeding direction; and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction wherein the contact pressure surface is parallel to the upper surface of the supporting member.

7. The image forming apparatus according to claim 6, further comprising:

a slanted section disposed between the separation roller and the feed roller, the slanted section being continuous with an opposed surface that is opposed to the separation roller, the slanted section being slanted with respect to the virtual tangential plane so as to be farther away up from the virtual tangential plane toward the downstream side in the sheet feeding direction.

8. The image forming apparatus according to claim 6, wherein the supporting member comprises a slanted surface disposed at an upstream end of the supporting member in the sheet feeding direction, the slanted surface being slanted with respect to the virtual tangential plane so as to be farther away down from the virtual tangential plane toward the upstream side in the sheet feeding direction.

9. The image forming apparatus according to claim 6, wherein the slanted guide surface is formed with an upstream region of the friction member relative to the contact pressure surface in the sheet feeding direction being curved.

10. The image forming apparatus according to claim 6, wherein the friction member comprises a slit disposed at a region that extends from the contact pressure surface to the slanted guide surface, the slit being cut in a thickness direction of the friction member.

11. A sheet feeder configured to feed sheets, comprising:

a friction member configured to contact a bottom one of the sheets to be fed and apply a frictional resistance to the sheets, the friction member being formed to have an even thickness over an entire length thereof in a sheet feeding direction;

a feed roller disposed to face the friction member, the feed roller configured to provide a feeding force to the sheets by rotating while contacting a top one of the sheets and applying to the sheets a pressing force for pressing the sheets against the friction member;

a supporting member attached to a main body of the sheet feeder, the supporting member being configured to support the friction member and receive the pressing force from the feed roller via the friction member, the supporting member being formed to have a bent surface on which the friction member is attached; and a separation roller configured to separate a plurality of sheets fed by the feed roller on a sheet-by-sheet basis, the friction member comprising:

a contact pressure surface configured to contact the feed roller in a situation where there is no sheet between the friction member and the feed roller, the contact pressure surface being disposed closer to the feed roller than an upper surface of the supporting member, such that a virtual tangential plane does not intersect with the supporting member, the virtual tangential plane of the contact pressure surface extending toward an upstream side and a downstream side in the sheet feeding direction; and a slanted guide surface disposed upstream relative to the contact pressure surface in the sheet feeding direction, the slanted guide surface being slanted with respect to the virtual tangential plane so as to be farther away down from the virtual tangential plane toward the upstream side in the sheet feeding direction wherein the contact pressure surface is parallel to the upper surface of the supporting member.

* * * * *